United States Patent [19]

Gawlinski

[11] 4,065,172

[45] Dec. 27, 1977

[54] ADJUSTABLE DECK CHAIR

[76] Inventor: Louis S. Gawlinski, 1550 Bervy St., San Diego, Calif. 92110

[21] Appl. No.: 688,397

[22] Filed: May 20, 1976

[51] Int. Cl.[2] ..... A47C 4/00

[52] U.S. Cl. ..... 297/19; 297/25; 297/29; 297/130; 297/438

[58] Field of Search ..... 297/29, 19, 20, 24, 297/25, 52, 51, 35–41, 115, 116, 117, 130, 420, 421, 417, 423, 438, 439

[56] References Cited

U.S. PATENT DOCUMENTS

| | | | |
|---|---|---|---|
| 281,617 | 7/1883 | Cove | 297/33 X |
| 614,370 | 11/1898 | Cummins | 297/438 X |
| 650,042 | 5/1900 | Gilmer | 297/359 X |
| 1,218,876 | 3/1917 | Liverson | 297/438 X |
| 1,685,599 | 9/1928 | Fletcher | 297/25 |
| 2,546,493 | 3/1951 | Booth | 297/359 X |
| 2,664,940 | 1/1954 | High | 297/24 |
| 3,822,913 | 7/1974 | Raver | 297/25 X |
| 3,929,373 | 12/1975 | Gawlinski | 297/29 |

FOREIGN PATENT DOCUMENTS

| | | | |
|---|---|---|---|
| 203,171 | 10/1958 | Austria | 297/33 |
| 963,088 | 6/1950 | France | 297/33 |

*Primary Examiner*—Roy D. Frazier
*Assistant Examiner*—Peter A. Aschenbrenner

[57] ABSTRACT

A sun chair is provided which is easily adjustable to achieve any conceivable orientation to which the human body will conform and comprises a lower platform which forms the bottom half of the chair deck and can be oriented to any angle between the horizontal and the vertical and supported in this position by a ground supporting member which is drawn toward the lower platform by either a strap or a rack structure, and an upper platform defining the upper half of the chair deck is pivoted to the lower half and supported on the ground support member such that it may achieve any conceivable angle relative to the lower platform.

2 Claims, 10 Drawing Figures

ADJUSTABLE DECK CHAIR

BACKGROUND OF THE INVENTION

The present deck chair is an extension and variation of the deck chair conceived and patented by applicant having U.S. Pat. No. 3,929,373. Both of these chairs are intended to provide a piece of deck furniture which is completely flexible to accommodate any position desired by sun bathers or the like.

A typical deck or outdoor lounge chair currently on the market has a tubular aluminum frame with synthetic webbing to support the body, there being numerous variations of this theme utilizing redwood frame members, tubular plastic cross members, and so forth. These chairs usually have an upper deck portion which can be adjusted angularly relative to the lower which is maintained horizontal, some of the chairs having a portion of the lower deck half which can be sloped downwardly to the ground to accommodate the calves. These chairs will support a sun bather lying on his back in a prostrate position and in the upright sitting position and a number of positions in between. However, primarily because of the fixed horizontal position of the lower half of the deck, but due to other limitations as well, conventional chairs will not fulfill the potential provided by the basic construction of two planes hinged together which can define a lounge of almost infinitely variable configuration.

The invention having the above-referenced Patent Number overcomes the limitations in prior lounges by providing upper and lower deck portions which are orientable in any conceivable usable position, and the present invention is quite similar insofar as the wide variety of possible orientations is concerned, but varies somewhat in the exact support structure as well as providing certain improvements in foot and arm rests.

SUMMARY OF THE INVENTION

The present invention provides in essence an upper and a lower platform which are hinged together to define the deck of a lounge chair, the bottom edge of the lower platform resting on the supporting surface and including a second ground support pivoted to the lower platform and forming a non-extensible triangle therewith by virtue of a connecting means such as a strap or a rack which extends between the ground support member and lower platform, the desired angle of the lower platform being variable by taking in or letting out the connecting means. An upper platform comprising the top portion of the chair deck is supported at any desired angle on a pair of braces or supports adjustably connected to and between the upper platform and the ground support member, the combination of the angular versatility of the upper and lower platform permitting the achievement of any desired composit orientation of the chair.

Novel arm rests are provided for the upper platform which may be adjusted so that they are horizontal regardless of the particular orientation of the upper platform, and a unique foot rest is utilized to support the body with the waist or the hip joints at the pivot point of the chair deck, this foot rest comprising a cylindrical member connected to the lower platform in one of several adjusted positions by means of chains engaged by the links thereof on studs or bolts projecting from the lower platform.

DETAILED DESCRIPTION OF THE PREFERRED EMBODIMENT

Figure 1:
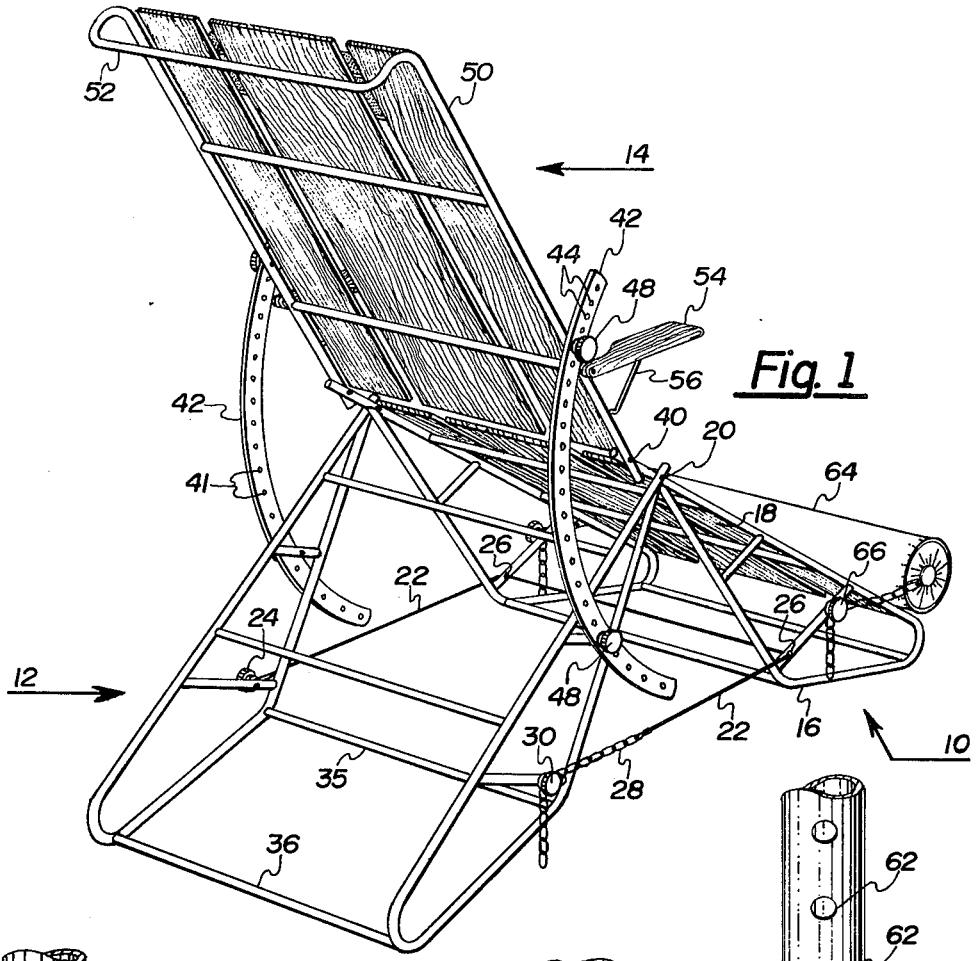
FIG. 1 is a perspective view of the chair from the upper right rear reviewing the details of the support structure.

The invention comprises in essence three major parts, a lower platform-defining member 10 which is also a ground contacting member, a ground support member 12 which is pivoted to the lower platform, and an upper platform member 14 which is pivoted to the lower platform 10 to define the deck portion of a lounge chair. Although as indicated the ground support 12 and upper platform 14 are both pivoted to the lower platform 10, this arrangement is somewhat arbitrary as clearly the same general result would be achieved if the three members are coaxially pivoted, or the upper platform were pivoted to the ground support member, etcetera.

Figure 7:
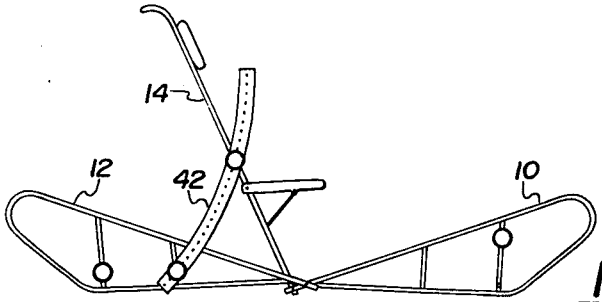
FIG. 7 is a diagrammatic view of yet another configuration of the chair.

The lower platform 10 is constructed in any fashion desirable, the configuration illustrated being examplary only and comprising tubular frame structure 16 which is most practically of aluminum construction, with the deck-defining portion of this platform constituting wooden slats 18 or other plane-defining structure. The ground support member 12 is similarly constructed of anything with the appropriate strength and the desirable light weightedness requisite in such construction and as illustrated is nearly identical to the frame 16 of the lower platform for purposes of manufacturing convenience. These two frame members are pivoted together at 20 and as they are drawn together at the lower ends, clearly the deck forming platform would achieve an angle which more closely approaches the vertical until an angle of approximately 60° with the horizontal is achieved. As these members are spread, the angle will of course approach the horizontal and actually pass beyond that point as shown in FIG. 7 so that the legs will point upwardly.

Two different connecting means to establish the spread of the ground support member and lower platform are disclosed, the first being a continuous cord or other flexible line 22 which is attached at 24 by means of a knob and a bolt or stud to a lower portion of the support member and passes through openings 26 in cross members of the lower platform frame, then returning to the other side of the ground support member, the line terminating in a length of chain 28 which is engaged through any desired link by means of a bolt or stud projecting from the frame member and retained thereon by means of a knob 30, which is threaded and easily removable to adjust the spread of the two ground contacting members of the chair.

Figure 8:
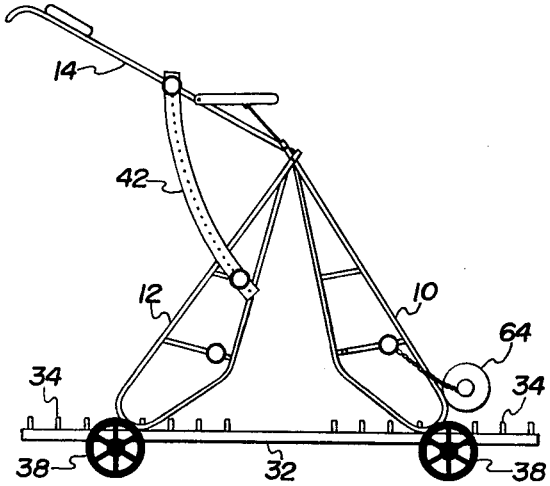
FIG. 8 is a diagrammatic view of yet another configuration of the chair wherein a nozzle rack structure is used to connect the ground contacting member.
Figure 9:
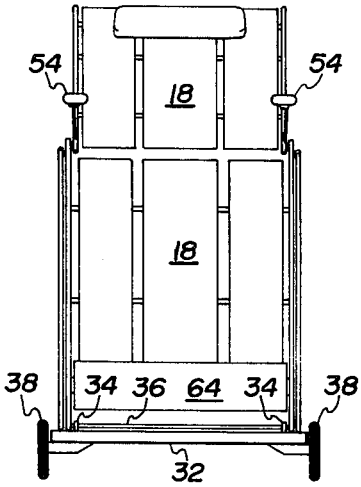
FIG. 9 is a diagrammatic view of the chair as arranged in FIG. 8 and as seen in front elevation.

The other method of connecting these two members is illustrated in FIGS. 8 and 9 and incorporates an elongated member 32 which is shown as a board in the drawing, this member having a plurality of uprights 34 which are pegs, as disclosed, but could as well be wooden panels or the like. Both the lower platform frame 16 and the ground support 12 include rungs 35 and 36 which are laterally disposed at the lowermost extremities of these members when they are expanded and drawn together, respectively, and these rungs are engaged upon selective pairs of pegs 34 to establish the spread of the ground contacting members, and thus the angle of the lower platform. It is contemplated that this connecting structure could be utilized in situations in which the chair would not normally be moved often, such as around the swimming pool in a hotel or resort setting, and by using the peg board, adjustment of the lower platform is reduced to the utmost in simplicity.

To accommodate those occasions in which it would be necessary to move the chair, the member 32 may be made rollable as is schematically indicated by the wheels 18, although in practicality it would be likely that at least one of the wheel pairs would be in the form of casters or otherwise pivotal around a vertical axis.

Figure 2:
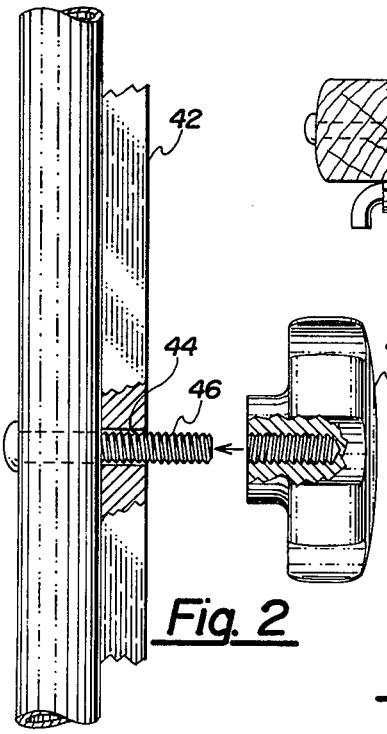
FIG. 2 is a view of a fragment of a frame tube of the upper platform showing the connection by means of a bolt and knob of the support strap.
Figure 3:
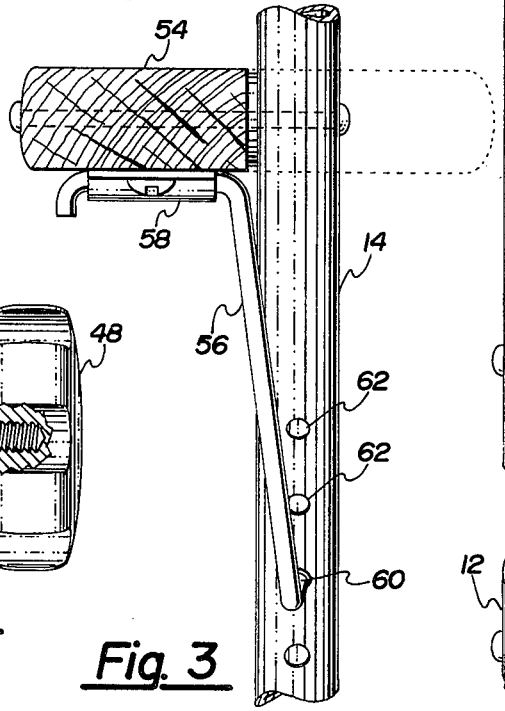
FIG. 3 is a section view of the left arm rest of the chair having the arm rest panel itself sectioned with the left portion illustrated in dotted line to reveal the bolt structure.
Figure 4:
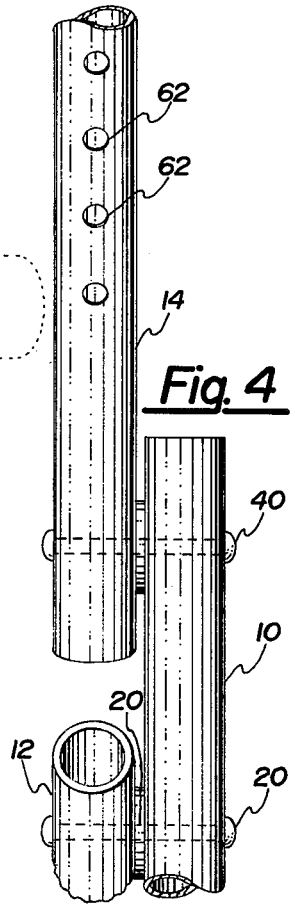
FIG. 4 is a detail of the lower platform tubular frame showing the connection thereof to fragments of the upper platform frame and ground support member.
Figure 5:
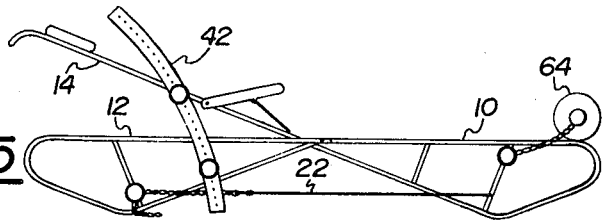
FIG. 5 is a diagrammatic view showing the chair arranged in conventional lounge fashion.
Figure 6:
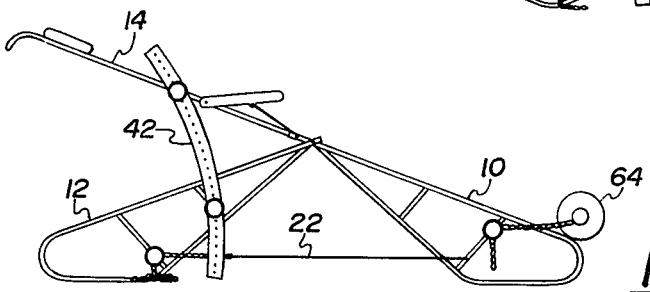
FIG. 6 is a diagrammatic view showing the chair arranged as a single plane.

As a suitable adjunct to the extreme versatility of positioning made available to the lower platform by its support structure, the upper platform is similarly highly adaptable in regard to its angular orientation. Its connection to the lower platform is pivotal at 40 and is supported in this position on a pair of struts 42 which are shown as arcuate but could be straight or of any other convenient configuration, these struts having a plurality of apertures 44 evenly spaced along the lengths thereof. As indicated in FIG. 2, these struts are engaged to both the upper platform and ground support member by means of lugs or bolts 46 which pass through the openings in the slats and are secured by means of knobs 48 in the same fashion the connecting chain is secured to the ground support member. It can thus be seen that by adjusting these slats and engaging different pairs of bores therein, virtually any orientation of the upper platform relative to the ground support member, and thus the lower platform can be achieved.

The structure of the upper platform is similar in concept if not in detail to the lower platform and comprises a tubular aluminum frame work 50 to which are mounted slats 52, the upper edge of this platform having an outwardly bent cross bar 53 to facilitate handling the chair. A pair of arm rests 54 are mounted to the tubular side members of the upper platform. Due to the adjustable nature of the upper platform, these arm rests are angularly adjustable on the upper platform so that regardless of the orientation the arm rests may be horizontally extended if desired for the comfort of the user.

The arm rest proper is bolted or otherwise pivoted to the tubular side member, and a brace 56 is pivoted or hinged at 58 to the bottom of the arm rest with the lower end of the brace being bent as at 60 so that it may be engaged in one of several holes 62 in the side member, to achieve the abovementioned horizontal position. Although other means of securely establishing the arm rests in the horizontal position are conceivable, the structure shown is effective and simple although not intended to be limiting.

Turning now to the lower platform, it is desirable that a rugged foot rest be incorporated at the bottom of the deck of the structure so that when the orientation such as that indicated in FIG. 8 is assumed, the user will be adequately supported and can adjust his positioning such that the pivot point between the two platforms coincides with the natural bending point of his body. The foot rest utilized in the present embodiment of the deck chair comprises an elongated member 64 which is cylindrical in the drawing although clearly if desired the same effect could be achieved by a foot rest of rectangular, triangular, or other cross section. The cylinder is preferably upholstered or padded for the comfort of the user who may often be in bare feet, and is adjustably connected to the lower platform by means of the stub and knob structure mounted to the lower platform and which engages selected ones of the lengths of the chains 68 which connect to the ends of the cylinder.

Figure 10:
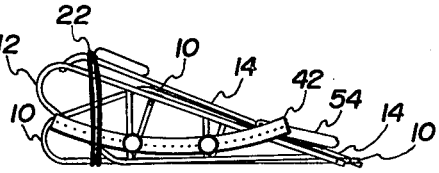
FIG. 10 is a diagrammatic view of the chair in collapsed position.

FIG. 10 illustrates the chair in collapsed position with the ground support member 12 and lower deck member 10 being folded together and all three of the major members being strapped together with the strap 22. In order for the unit to collapse as in the illustration, the two braces 35, or at least the one on the ground support member 12, would obviously have to be omitted which would pose no difficulty if the strap 22 is used since the primary function of these braces is to permit the engagement of the lower members on the rack uprights 34.

The deck chair of the above description is easily fabricated of tubular aluminum according to current manufacturing techniques and by virtue of the unique arm and foot rests and support structure provides a unit of versatility and practicality even exceeding its predecessor.

I claim:

1. An adjustable deck chair comprising;

a. an upper platform and a lower platform hinged together to define an elongated deck portion of a chair;

b. a ground support member pivoted to one of said platforms to support same above a generally horizontal surface;

c. a rigid support brace structure connected to and between said upper platform and said ground support; and d. means connecting said lower platform and ground support together such that upon receiving the weight of a person tension is applied to said connecting means, and said platforms, connecting means, ground support, and brace structure are maintained rigid;

e. said connecting means comprising an elongated member extendable on a horizontal surface and having means to releasibly engage at a plurality of different positions thereon both said lower platform and said ground support to prevent the separation thereof;

f. said elongated member being rigid and provided with wheels such that said chair is easily mobile when said ground support and lower platform are engaged on said elongated member.

2. An adjustable deck chair comprising:

a. an upper platform and a lower platform hinged together to define an elongated deck portion of a chair;

b. a ground support member pivoted to one of said platforms to support same above a generally horizontal surface;

c. a rigid support brace structure connected to and between said upper platform and said ground support; and d. means connecting said lower platform and ground support together such that upon receiving the weight of a person tension is applied to said connecting means, and said platforms, connecting means, ground support, and brace structure are maintained rigid;

e. said connecting means comprising an elongated member extendable on a horizontal surface and having means to releasibly engage at a plurality of different positions thereon both said lower platform and said ground support to prevent the separation thereof;

f. said means to engage comprising a plurality of uprights spaced along said elongated member, and said ground support and lower platform are each provided with a laterally extended rung engageable on selected pairs of said uprights.

* * * * *